US006567052B1

(12) United States Patent
Wang et al.

(10) Patent No.: US 6,567,052 B1
(45) Date of Patent: May 20, 2003

(54) STRATOSPHERIC PLATFORM SYSTEM ARCHITECTURE WITH ADJUSTMENT OF ANTENNA BORESIGHT ANGLES

(75) Inventors: Weizheng Wang, Rancho Palos Verdes, CA (US); Donald C. D. Chang, Thousand Oaks, CA (US); Ming Chang, Rancho Palos Verdes, CA (US); Ying Feria, Manhattan Beach, CA (US)

(73) Assignee: Hughes Electronics Corporation, El Segundo, CA (US)

( * ) Notice: Subject to any disclaimer, the term of this patent is extended or adjusted under 35 U.S.C. 154(b) by 0 days.

(21) Appl. No.: 09/718,973

(22) Filed: Nov. 21, 2000

(51) Int. Cl.[7] ..... H01Q 3/00

(52) U.S. Cl. ..... 343/765; 343/705; 455/431

(58) Field of Search ..... 343/705, 706, 343/708, 765, DIG. 2, 429; 455/431; 244/3.14

(56) References Cited

U.S. PATENT DOCUMENTS

| | | | | |
|---|---|---|---|---|
| 5,612,701 A | | 3/1997 | Diekelman | 342/354 |
| 5,790,070 A | | 8/1998 | Natarajan et al. | |
| 5,949,766 A | | 9/1999 | Ibanez-Meier et al. | |
| 5,974,317 A | * | 10/1999 | Djuknic et al. | 455/431 |
| 5,982,337 A | | 11/1999 | Newman et al. | 343/816 |
| 6,034,634 A | | 3/2000 | Karlsson et al. | 342/359 |
| 6,105,060 A | | 8/2000 | Rothblatt | 709/219 |
| 6,111,542 A | | 8/2000 | Day et al. | |
| 6,147,658 A | | 11/2000 | Higashi et al. | |
| 6,151,308 A | | 11/2000 | Ibanez-Meier et al. | |
| 6,173,178 B1 | | 1/2001 | Hammill et al. | 455/429 |
| 6,176,451 B1 | * | 1/2001 | Drymon | 244/3.14 |
| 6,204,823 B1 | * | 3/2001 | Spano et al. | 343/766 |
| 6,236,834 B1 | | 5/2001 | Poskett et al. | 455/13.1 |
| 6,259,415 B1 | * | 7/2001 | Kumpfbeck et al. | 343/765 |
| 6,388,615 B1 | | 5/2002 | Chang et al. | 342/368 |
| 2002/0006795 A1 | | 1/2002 | Norin et al. | 455/429 |

FOREIGN PATENT DOCUMENTS

| | | |
|---|---|---|
| EP | 0 549 220 A | 6/1993 |
| WO | WO 96 31016 A | 10/1996 |
| WO | WO 99 13598 A | 3/1999 |
| WO | WO 99 23769 A | 5/1999 |
| WO | WO 01/97388 A2 | 12/2001 |
| WO | WO 01/97406 A2 | 12/2001 |

OTHER PUBLICATIONS

U.S. patent application Ser. No. 09/594,374, Chang et al., filed Jun. 15, 2000.

U.S. patent application Ser. No. 09/649,355, Hagen et al., filed Aug. 28, 2000.

U.S. patent application Ser. No. 09/594,375, Wang et al., filed Jun. 15, 2000.

K. K. Chan et. al, "A Circularly Polarized Waveguide Array for Leo Satellite Communications", Antennas and Propagation Society, 1999, IEEE International Symposium, vo.l. 1, Jul. 11–16, 1999, pp. 154–157.

R. Suzuki et. al, "Mobile TDM/TDMA System With Active Array Antenna", Global Telecommunications Conference, 1991, GLOBECOM '91, vol. 3, Dec. 2–5, 1991, pp. 1569–1573.

(List continued on next page.)

*Primary Examiner*—Don Wong
*Assistant Examiner*—Shih-Chao Chen
(74) *Attorney, Agent, or Firm*—V. D. Duraiswamy; M. W. Sales

(57) ABSTRACT

A stratospheric platform communication system (10) having antenna boresight angles (EL, AZ) that can be adjusted by an adjustable payload antenna (40) according to the requirements of a specific application. The present invention provides an efficient use of available resources by allowing platform systems (10) and GEO satellite systems to share the radio frequency spectrum without interference, and improves the coverage area provided by a stratospheric platform system by allocating stratospheric platforms (12) to specific coverage areas in combination thereby increasing coverage capacity in high traffic areas.

16 Claims, 10 Drawing Sheets

OTHER PUBLICATIONS

Yokosuka Research park, "The First Stratospheric Platform Systems Workshop", May 12–13, 1999, pp. 1–216.
Colella N J et al., "The HALO Network ™", IEEE Communications Magazine, IEEE Service Center, Piscataway, N.J. U.S., vol. 38, No. 6, Jun. 2000, pp. 142–148, XP 000932657, ISSN: 0163–6804.
Masayuki Oodo, Et Al., "Onboard DBF Antenna for Stratospheric Platform", Phased Array Systems and Technology, 2000. 2000 IEEE International Conference, May.
Ryu Miura, Et Al., "A DBF Self–Beam Steering Array Antenna For Mobile Satellite Applications Using Beam–Space Maximal–Ratio Combination," IEEE Transactions on Vehicular.
Kazuo Sato, Et Al., "Development And Field Experiments of Phased Array Antenna For Land Vehicle Satellite Communications," Antenna and Propagation Society.

* cited by examiner

Platform #1 Coverage Area

Platform #2 Coverage Area

Platform #3 Coverage Area

All Three Platforms Coverage Area

STRATOSPHERIC PLATFORM SYSTEM ARCHITECTURE WITH ADJUSTMENT OF ANTENNA BORESIGHT ANGLES

TECHNICAL FIELD

The present invention relates generally communications systems, and more particularly to a stratospheric platform communications system having a platform antenna with adjustable boresight angles.

BACKGROUND ART

Communication satellites, such as geosynchronous earth orbit (GEO) satellite systems, have become commonplace for use in many types of communication services, i.e., data transfer, voice communications, television spot beam coverage, and other data transfer applications. As such satellites transmit and receive signals in predetermined configurations, i.e. bent pipe, or spot array, to focus signals in a desired geographic location on the Earth.

A stratospheric platform system employs airships, solar electric airplanes, or hydrogen powered electric airplanes, flying in the stratosphere. A stratospheric platform is located much closer to the Earth in comparison to a GEO satellite. A stratospheric platform can be viewed as an extra low-orbit GEO system if the stratospheric platform can maintain very tight station keeping standards.

Resources are scarce for over-the-air transmission. Therefore, various multiple-access schemes are used to provide a greater number of communication signals within an allocated communication band spectrum. Such multiple access schemes include code division multiple access (CDMA), time division multiple access (TDMA), frequency division multiple access (FDMA), or a combination of these schemes. Further, to prevent interference, the schemes may operate at different frequencies.

A frequency spectrum is assigned to direct broadcasting satellite (DBS) systems that are placed in GEO orbit. The DBS orbit slots have nine degrees or larger separation angels between two nearest DBS satellite locations. Currently there are eight GEO positions allocated to American DBS which are located at 175 W, 166 W, 157 W, 148 W, 119 W, 110 W, 101 W, and 61.5 W.

There is a need for a method and system that efficiently uses the resources available in a stratospheric platform system and that can adjust the capacity of a coverage area based on the use distribution in the coverage area.

SUMMARY OF THE INVENTION

It is an object of the present invention to efficiently use the frequency spectrum available for a stratospheric platform system. It is another object of the present invention to adjust the capacity of a coverage area. It is yet another object of the present invention to adjust the capacity of the coverage area based on a use distribution for the coverage area.

It is a further object of the present invention to adjust the stratospheric platform such that it is in a position that is most desirable for communicating. It is still a further object of the present invention to avoid interference with other wireless communication systems.

The present invention enables available resources to be used in the most efficient manner. The stratospheric platforms can operate at the same frequency spectrum as the DBF without interference from one another. In carrying out the above objects, the present invention provides a stratospheric platform system architecture with adjustable platform payload antenna boresight angles. The boresight angles are fine tuned to angle the antennas such that they benefit the communication system, effectively design a coverage capacity for a coverage area, and provide a system that may share a frequency spectrum with direct broadcasting GEO satellite systems.

These and other features of the present invention will be better understood with regard to the following description, appended claims, and accompanying drawings.

BEST MODE FOR CARRYING OUT THE INVENTION

Figure 1:
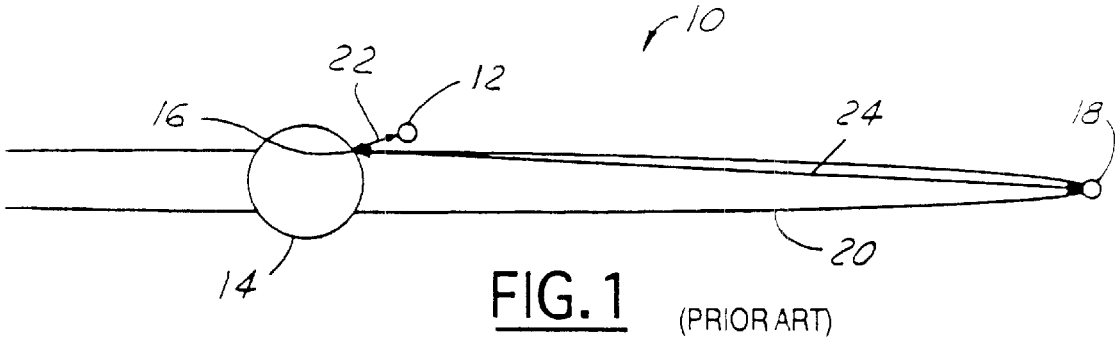
FIG. 1 (PRIOR ART)
FIG. 1 is a depiction of the differences in the orbit size for a GEO satellite and a stratospheric platform.

Referring to FIG. 1 there is shown a communications system 10 that has a stratospheric platform 12 positioned above the Earth 14. The stratospheric platform 12 communicates with a user 16 on the Earth 14. A line-of-sight 22 exists between the platform 12 and the user 16. FIG. 1 also shows a geosynchronous satellite 18 having an orbit 20. The geosynchronous orbit 20 allows the satellite 18 to maintain a relatively fixed position above a point on the Earth 14. A line-of-sight 24 for the satellite 18 has an elevation angle that differs significantly from the line-of-sight elevation angle for the platform 12. It should be noted that while FIG. 1 shows only one platform 12, the present invention is applicable to several platforms.

The stratospheric platform 12 may comprise one of many types of stratosphere-based devices such as unmanned planes, balloons, dirigibles, or the like. Stratospheric platforms deploy relatively rapidly compared to satellites and therefore, if the need increases, the system capability may be increased or modified.

Figure 2:
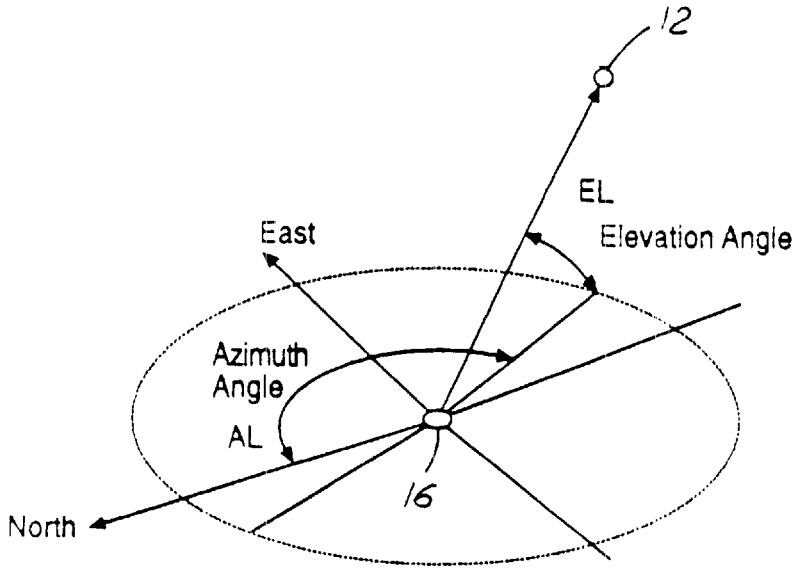
FIG. 2 (PRIOR ART)
FIG. 2 is an illustration of azimuth and elevation angles for a stratospheric platform.

FIG. 2 is an illustration of a stratospheric platform having an elevation angle EL with respect to the user 16. The azimuth angle AL of the stratospheric platform 12 is also illustrated. Azimuth angle AL is the angle from North. The azimuth angle and the elevation angle for the stratospheric platform may vary depending on the location of the stratospheric platform 12. Of course, the height of the stratospheric platform 12 must also be taken into consideration.

Figure 3:
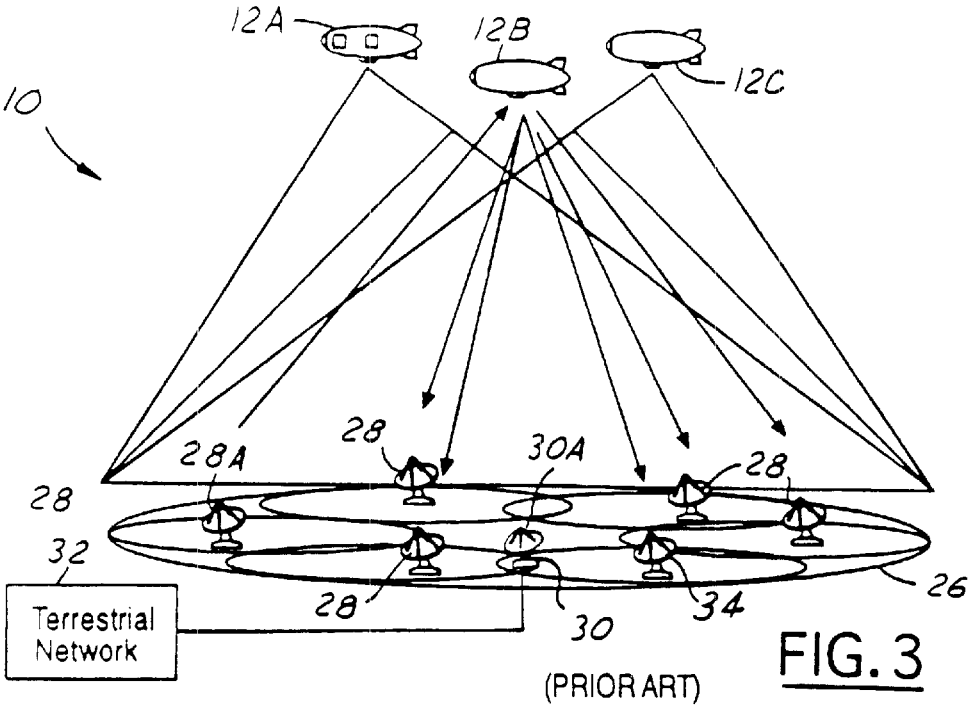
(PRIOR ART) FIG. 3
FIG. 3 is an illustration of a stratospheric platform system having a plurality of platforms and providing service to a plurality of fixed and mobile users.

Referring now to FIG. 3, there is shown a communications system 10 having a plurality of platforms, 12A, 12B and 12C used to cover a predetermined service area 26 on the Earth's surface. Although three platforms are used for illustrative purposes, only one is necessary, and more may be used. A plurality of user terminals 28 are shown. The user terminals 28 are fixed and may, for example, comprise business-based or home-based communications systems. Each user terminal 28 may receive a signal with a predetermined signal strength or receive an antenna radiation spot in a spot beam pattern that is available from and provided by the stratospheric platforms 12A, 12B, 12C.

The communication system 10 further includes a gateway station 30 that is coupled to a terrestrial network 32 and a device operations center 34. Both the gateway station 30 and the device operations center 34 are in communication with the platforms 12A, 12B, and 12C. The gateway station 30 provides a link between user terminals 28 and terrestrial networks 32 through the stratospheric platforms 12A, 12B, and 12C.

A device operations center 34 provides command and control functions to the platforms 12A, 12B, and 12C. Although illustrated as two separate units, the gateway station 30 and the device operations center 34 may be combined in the same physical location.

The platforms 12A, 12B, and 12C are used as a communications node for the gateway station 30 and user terminals 28 which have antennas that are pointed in the direction of the platforms 12A, 12B, 12C. The gateway antenna 30A of the gateway station 30 and user terminals antennas 28A have a beam width that is small enough to maintain communication links with the platforms 12A, 12B, or 12C separately. The antennas 28A, 30A allow for large data throughput.

Figures 4A, 4B, 4C:
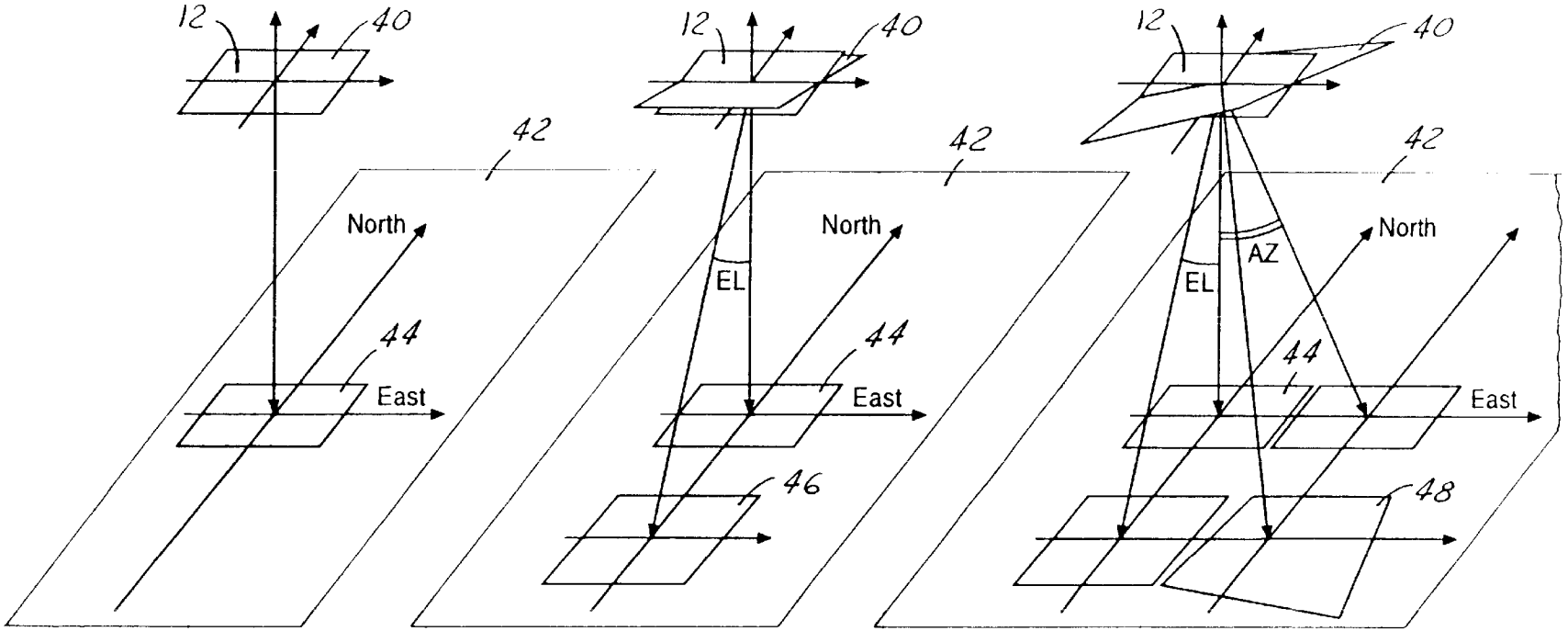
FIG. 4A is an illustration of a stratospheric platform having an antenna with zero antenna boresight azimuth and elevation angles.
FIG. 4B is an illustration of a stratospheric platform having an antenna with a non-zero antenna boresight elevation angle.
FIG. 4C is an illustration of a stratospheric platform having an antenna with non-zero antenna boresight elevation and azimuth angles.

The present invention provides a stratospheric platform system having adjustable payload antenna boresight angles. FIGS. 4A, 4B and 4C illustrate the boresight angles for a stratospheric platform 12 with an antenna 40 having different adjustments. FIG. 4A is an illustration of a stratospheric platform 12 in which the antenna 40 has a zero boresight azimuth angle and a zero boresight elevation angle. The boresight angle is defined as the angle between the antenna farm boresight and the platform nadir direction. FIG. 4B is an illustration of a stratospheric platform 12 in which the antenna 40 has a zero boresight azimuth angle and a nonzero boresight elevation angle, EL. FIG. 4C is an illustration of a stratospheric platform 12 having an antenna, 40 with a nonzero boresight azimuth angle AZ and a nonzero boresight elevation angle EL.

FIGS. 4A, 4B and 4C illustrate that changing the position of the platform antenna 40 changes the location and the shape of the coverage area on the ground 42. For the example shown in FIG. 4A, for which the platform antenna 40 is parallel with the coverage ground 42, the projected coverage area 44 is located exactly underneath the platform 12. When the platform payload antenna 40 is tilted a certain angle, the coverage area center is changed. FIG. 4B shows the antenna 40 in parallel with the East-West axis of the coverage ground 42 and tilted with respect to the North-South axis. The angle to the North-South axis is the boresight elevation angle, EL. When the boresight elevation angle is nonzero, as shown in FIG. 4B, the projected coverage area 46 shifts along the North-South axis. The shape of the coverage area 46 is different than the shape of the coverage area 44 when the antenna is parallel to the coverage ground 42, assuming the antenna is the same for both cases.

FIG. 4C shows a general case when the antenna has a nonzero boresight elevation angle and a nonzero boresight azimuth angle. In FIG. 4C the antenna 40 is neither in parallel with the North-South axis, nor in parallel with the East-West axis. Again, the boresight elevation angle EL is the angle of the antenna with respect to the North-South axis and the boresight azimuth angle AZ is the angle of the antenna with respect to the East-West axis. The projected coverage area 48 is shifted along both axes when the elevation and azimuth angles are both non-zero.

It is possible for a stratospheric platform system to share frequency bandwidths with a direct broadcasting satellite system (DBS). The DBS are allocated to a GEO orbit. The orbit allocation is limited for each country. For example, there are 8 orbit slots currently assigned to the United States DBS, which are located at 175 W, 166 W, 157 W, 148 W, 119 W, 110 W, 101 W, and 61.5 W.

Figure 5:
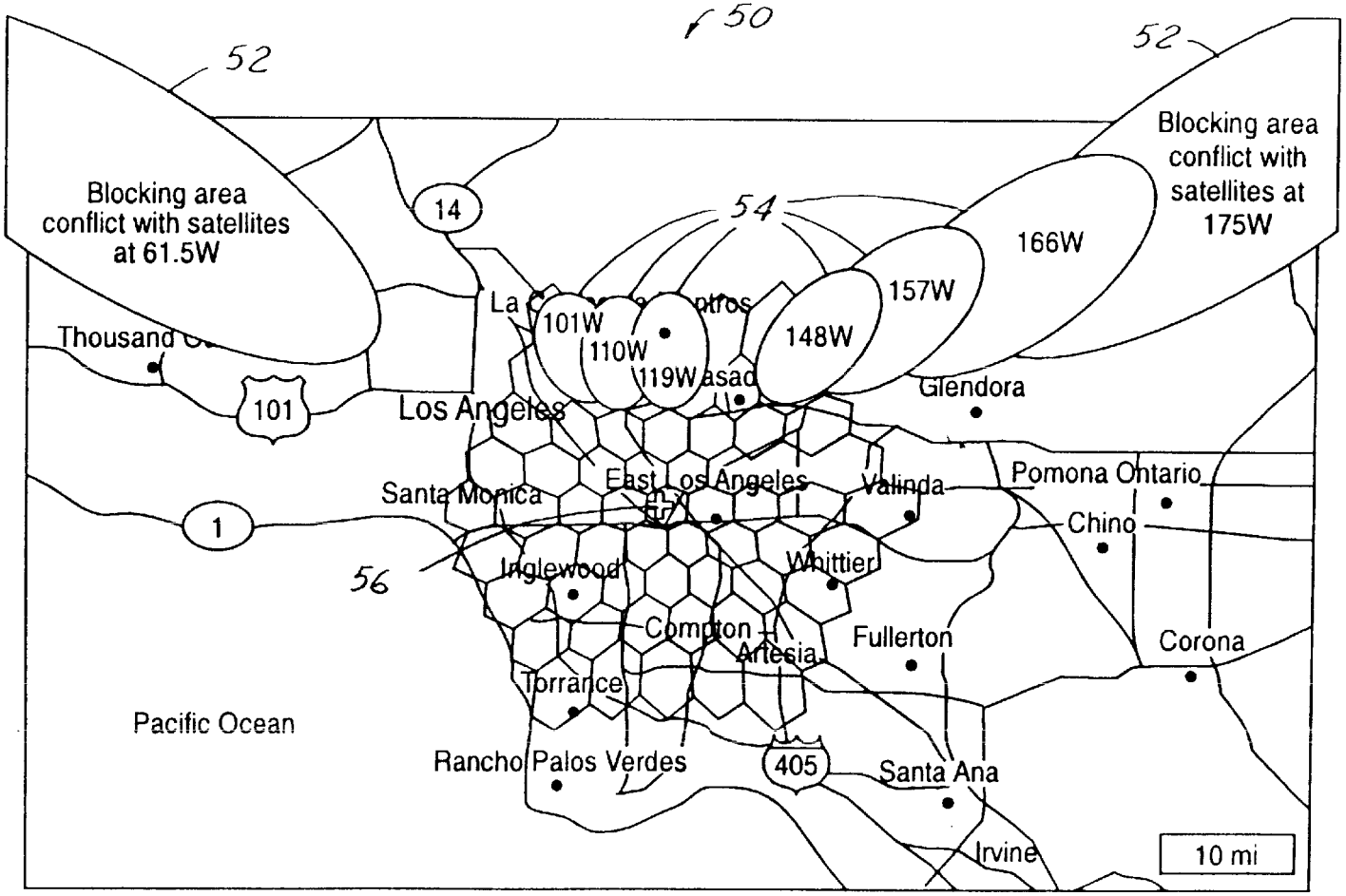
FIG. 5 is an illustration of the coverage area and blocking areas for a stratospheric platform having an antenna that is parallel with the surface of the Earth.

When a stratospheric platform is deployed, the service area of the platform may have certain blocking areas in its service coverage area. In the blocking areas, the angle between a user towards the stratospheric platform and the user towards a DBS satellite is less than a certain required separation angle. Other than the blocking areas, the interference between the DBS system and a stratospheric platform system is negligible. FIG. 5 is an example of the Los Angeles, Calif. area 50 depicting the blocking areas 52, 54 when a stratospheric platform is located over the Los Angeles area. There are eight overlapping oval zones, which are close to the northern edge of the stratospheric platform coverage areas, indicated by hexagonal cells. These oval zones are the areas of exclusion for the platform services.

FIG. 5 can be related to FIG. 4A in that the azimuth and elevation angles are both zero. A center spot 56 indicates the projected platform location. The projected oval locations of the blocking areas 52 are highly correlated to the stratospheric platform location. For example, if the platform moves North by a predetermined number of kilometers, i.e. three kilometers, all of the blocking areas move by a distance slightly different than, but very close to the predetermined number of kilometers, i.e. three kilometers, as well.

It becomes clear that when the stratospheric platform system is sharing the frequency spectrum with the DBS system, the exclusion zones must be blocked out because of potential interference with the DBS system. Without tilting the antenna boresight, a considerable portion of the coverage area must be blocked out to eliminate the potential interference to the DBS operation.

Figure 6:
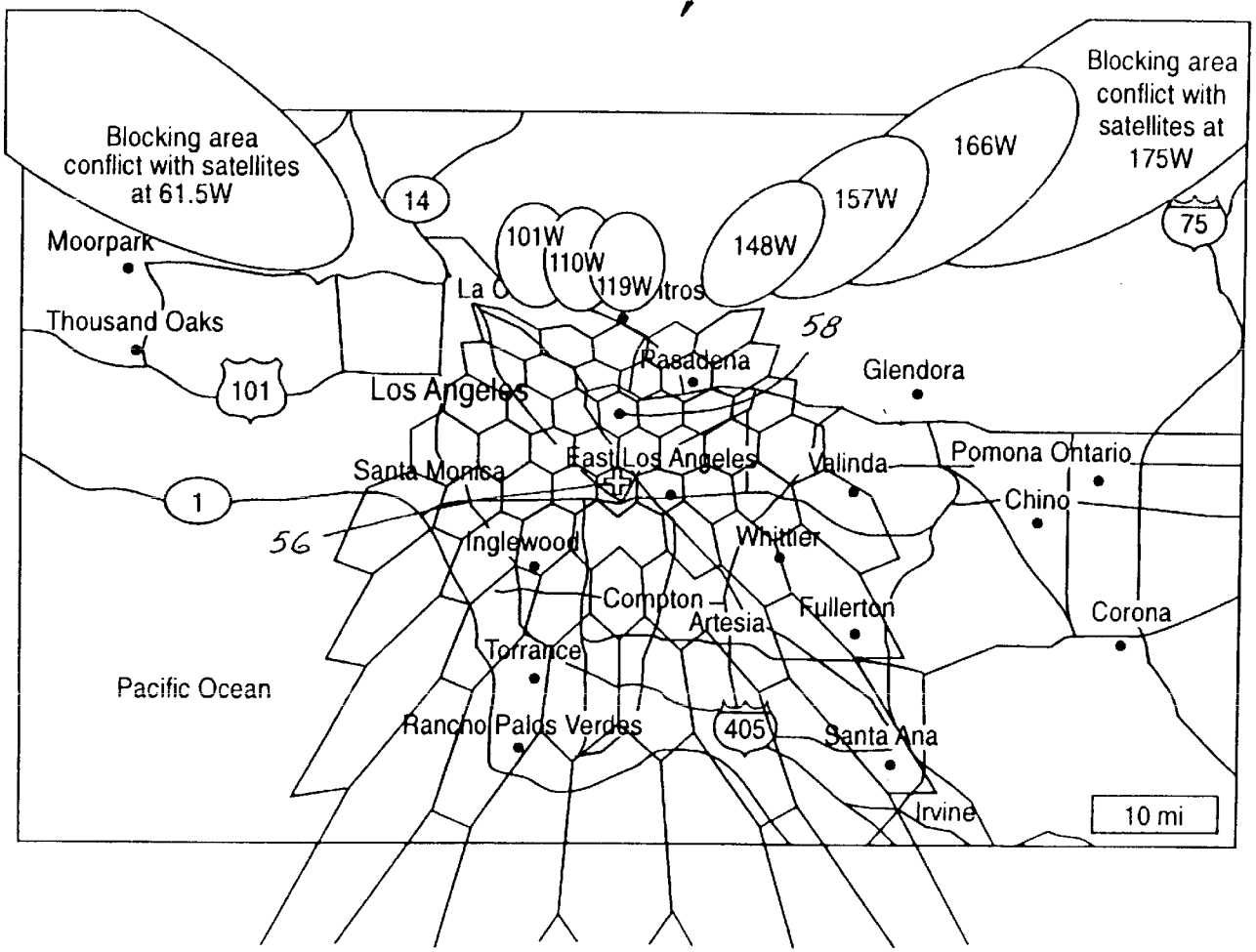
FIG. 6 is an illustration of the coverage area and blocking areas for a stratospheric platform having an antenna having a non-zero elevation angle.

In applying the adjusted boresight angles and moving the stratospheric platform locations according to the present invention, frequency spectrum sharing between the stratospheric platform system and the DBS system is facilitated. Merely setting the boresight elevation angle north 9 degrees, keeping the boresight azimuth angle to zero, and moving the platform north by a few kilometers will significantly change the coverage area. FIG. 6 is an illustration of the altered coverage area. The nadir of the platform 58 is shifted North. A cross 56 indicates the new antenna boresight.

It is clear that the projected stratospheric platform location 58 has moved North. As mentioned above, the blocking areas are a function of the stratospheric platform location. With the re-allocation of the platform toward North, the blocking areas move also. With the exact same antenna boresighted at the same geographical location on the ground as shown in FIG. 5, the coverage area is changed as shown in FIG. 6. Re-boresighting the antenna to the same geographic location after the stratospheric platform is moved north to a new location can be accomplished merely by introducing a non-zero boresight elevation angle.

Figure 7:
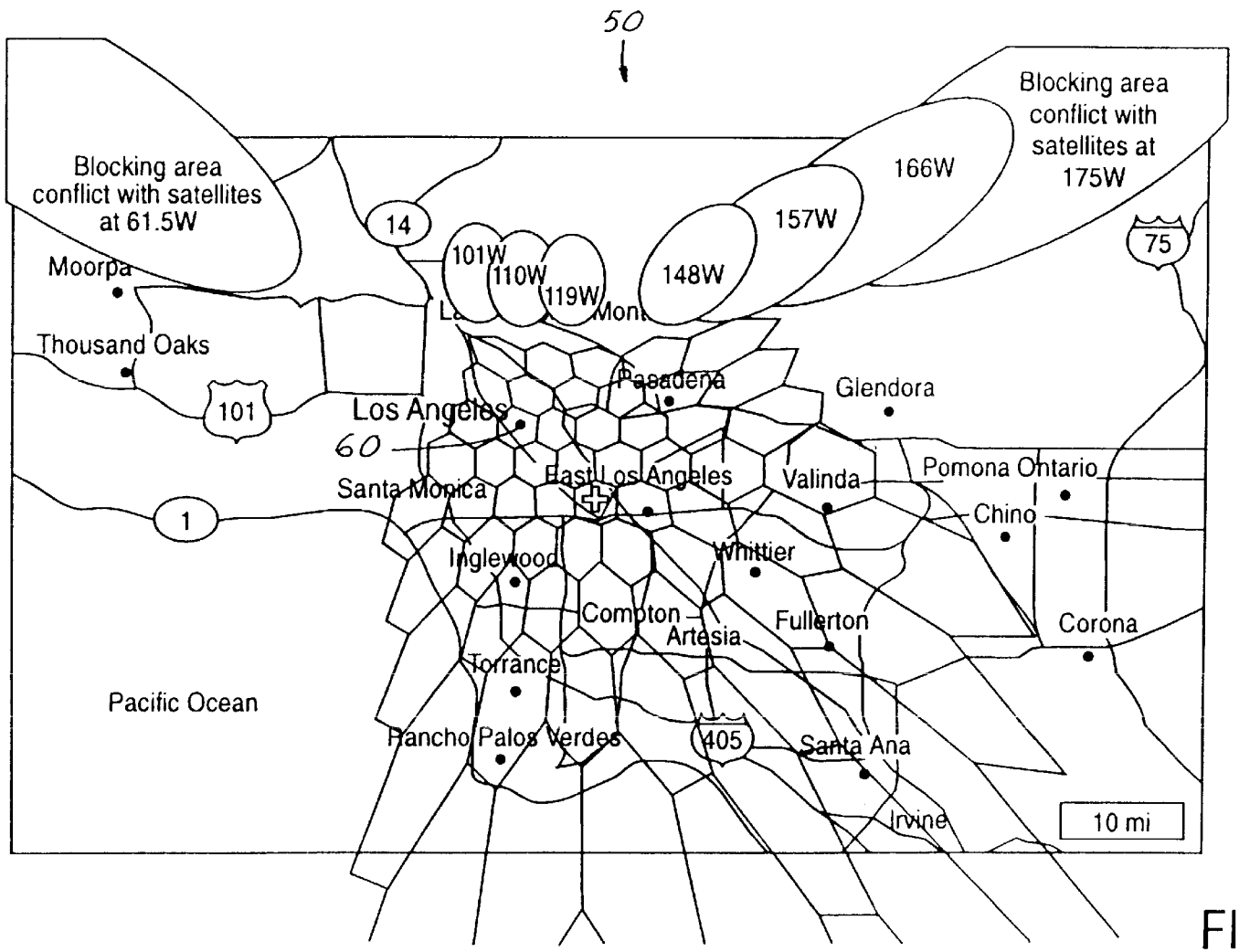
FIG. 7 is an illustration of the coverage and blocking areas for a stratospheric platform having an antenna having non-zero azimuth and elevation angles.

Refer to FIG. 7 for a further comparison. The coverage area shown in FIG. 7 is adjusted further by changing the azimuth angle West by four degrees to re-boresight the antenna to the same geographical location 56 after the stratospheric platform moved west from the location 58 to the location 60. The original center 56 of the coverage area is shown for reference. FIG. 7 clearly shows that the blocking areas (eight oval zones) have moved west as compared to FIG. 6.

Another example of an application of the present invention is in the design of a stratospheric platform communication system. It is possible to design the system such that the coverage for a metropolitan area is customized to meet the demands of the particular area. For example, consider the Los Angeles metropolitan area. The design goal is to cover the entire populated area, and at the same time provide more capacity to potential heavy traffic areas. The traffic is heaviest in downtown Los Angeles, therefore the concentration of the coverage is focused in that area.

The stratospheric platform communication system is designed to cover maximum area while using a minimum number of platforms. The present invention can be used to improve the efficiency by maximizing coverage with a minimum number of platforms. The present invention can also be used to take into account the uneven distribution of wireless communication traffic within a coverage area and maximize coverage in this respect as well.

FIGS. 8A through 8D represent the Los Angeles area and stratospheric platform system coverage using a minimum number of platforms for maximum coverage. Using the boresight angle adjustment of the present invention, potential solutions for the deployment of three platforms servicing the Los Angeles area are presented.

Figure 8A:
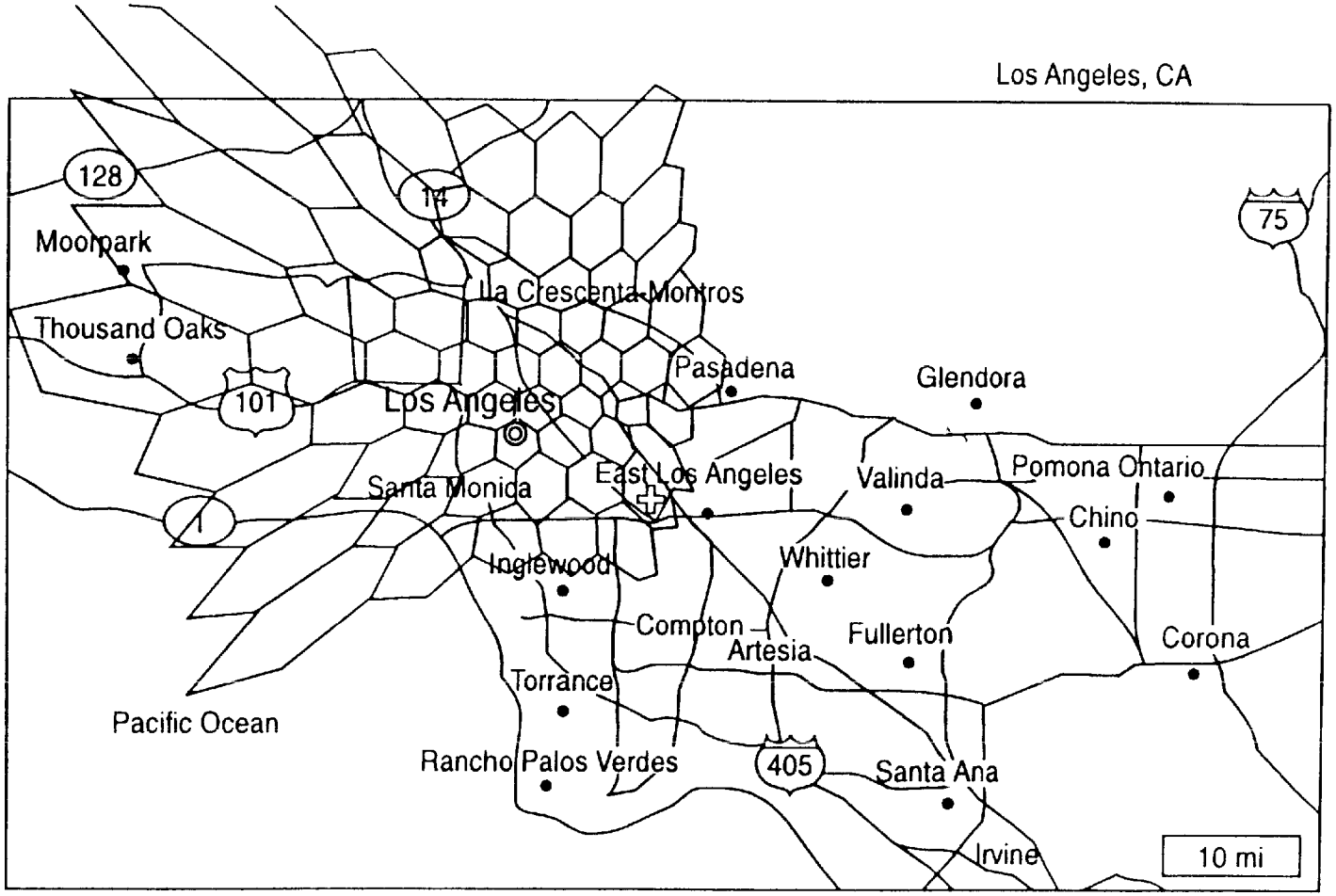
FIG. 8A is an illustration of the coverage area for a first platform having non-zero azimuth and elevation angles.
Figure 8B:
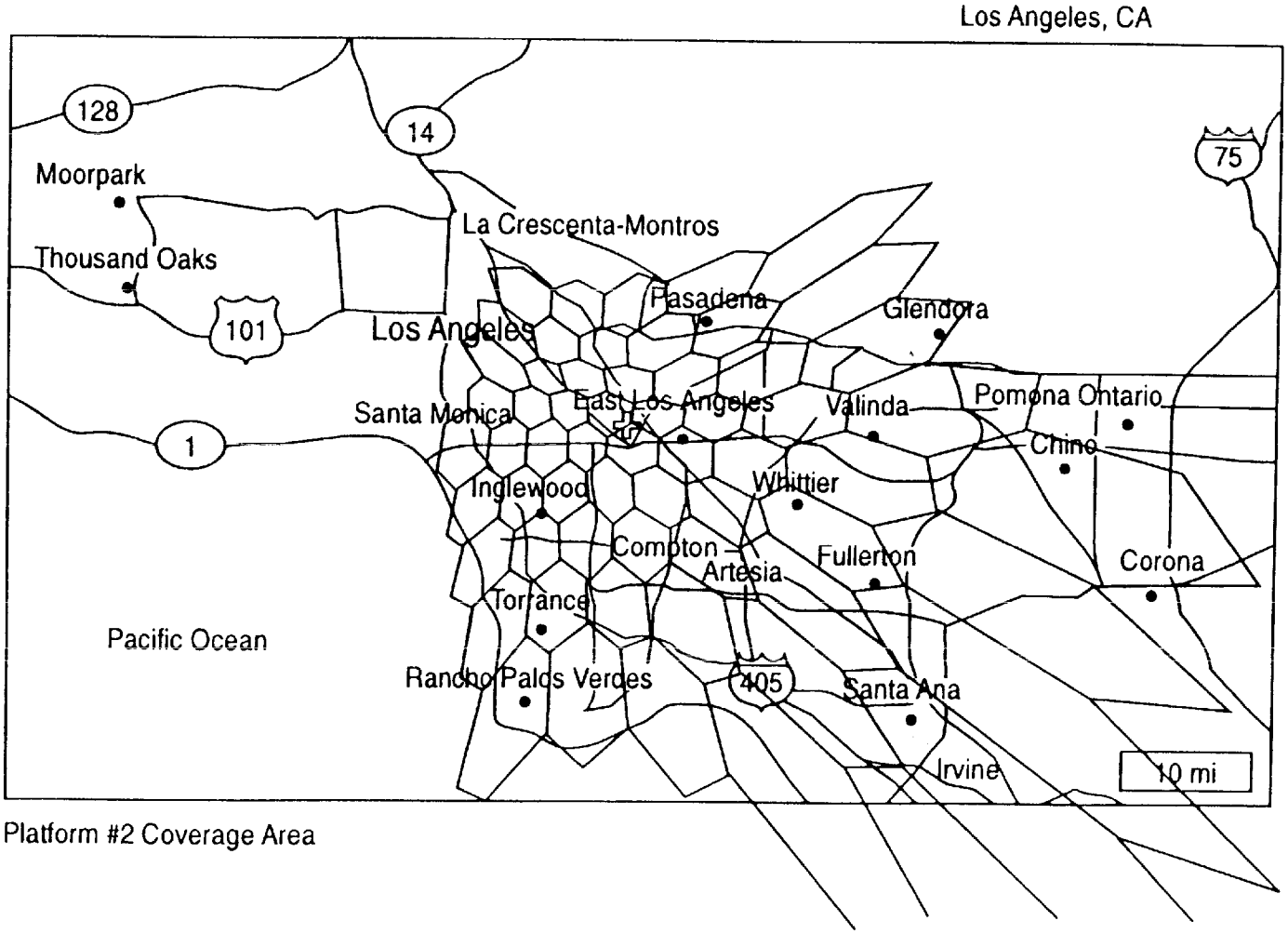
FIG. 8B is an illustration of the coverage area for a second platform having non-zero azimuth and elevation angles.
Figure 8C:
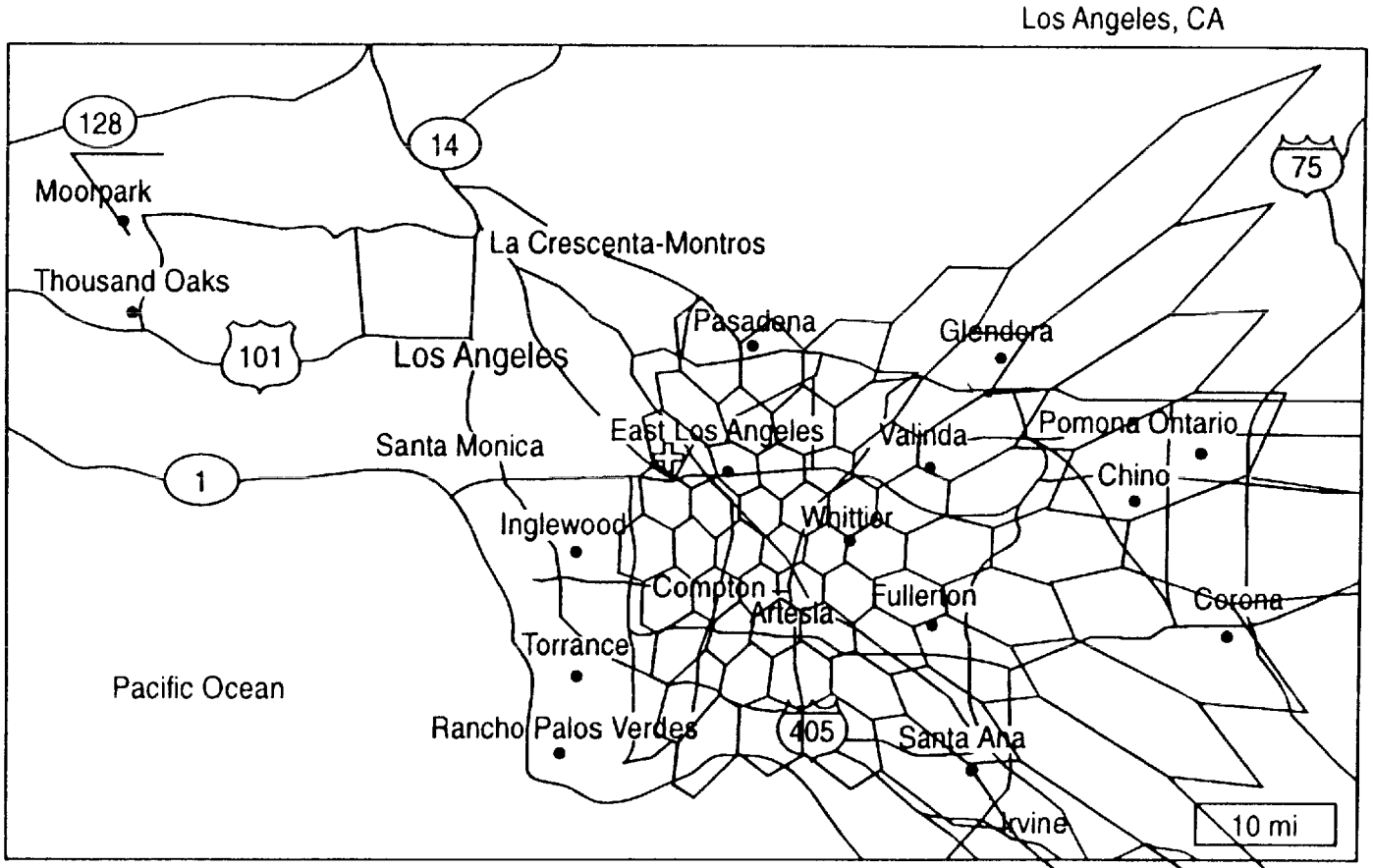
FIG. 8C is an illustration of the coverage area for a third platform having non-zero azimuth and elevation angles.
Figure 8D:
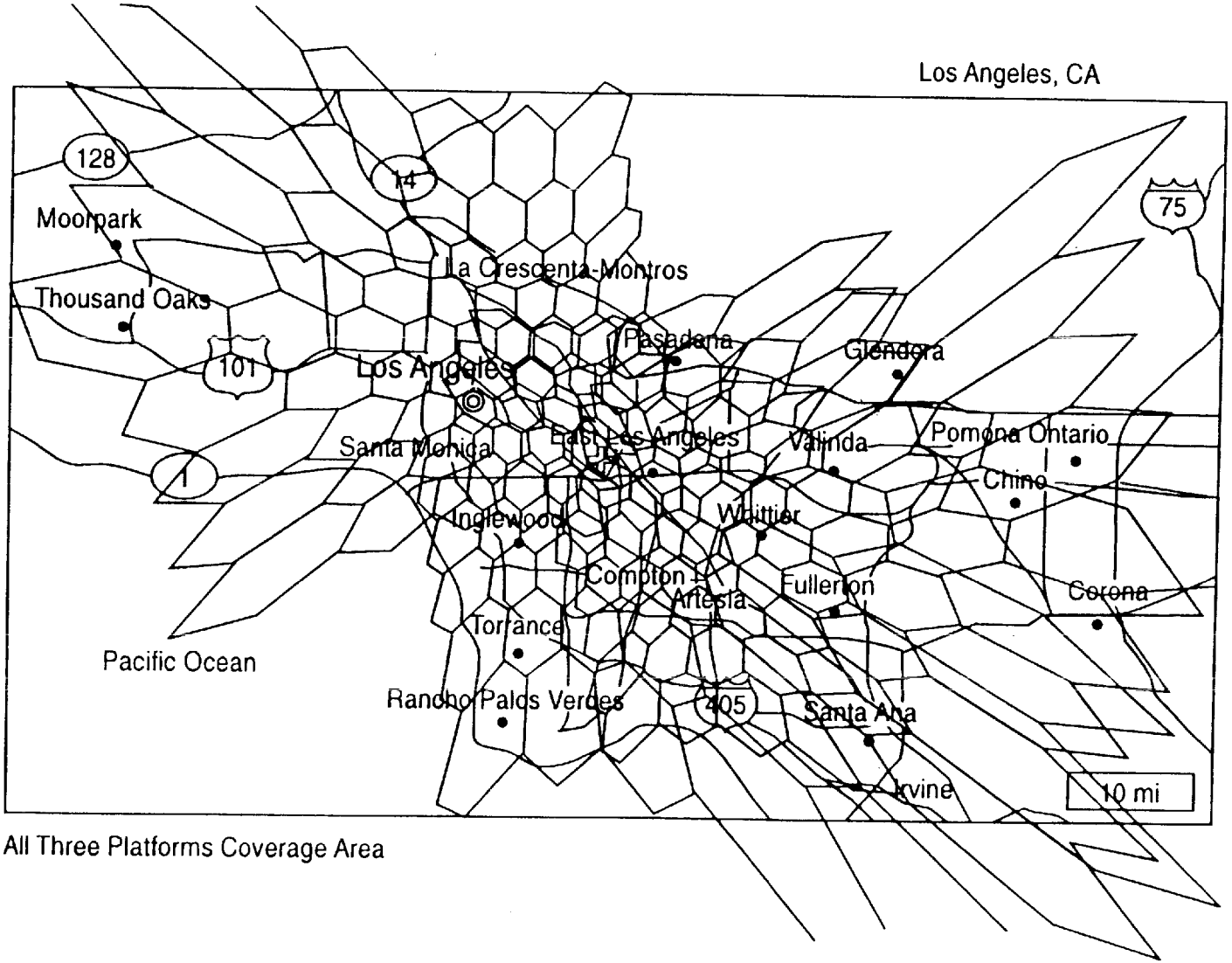
FIG. 8D is an illustration of the combined coverage area for the first, second and third platforms.

FIGS. 8A, 8B, and 8C represent a coverage area for three different platforms. A first platform provides the coverage shown in FIG. 8A, a second platform provides the coverage shown in FIG. 8B and a third platform provides the coverage shown in FIG. 8C. Each platform has non-zero azimuth and elevation angles in order to position the projected coverage area as shown in each of the figures. All three of the platforms combined provide the coverage area shown in FIG. 8D. Each of the platforms provides coverage of a portion of the Los Angeles area as shown in FIGS. 8A, 8B and 8C, and when combined provide a greater concentration of coverage in the high traffic area of downtown Los Angeles as shown in FIG. 8D.

The present invention provides a stratospheric platform communication system having antenna boresight angles that can be adjusted according to the requirements of a specific application. The present invention provides an efficient use of available resources by allowing stratospheric platform systems and GEO satellite systems to share the same radio frequency spectrum without interference, and improves the coverage area provided by a stratospheric platform system by allocating stratospheric platforms to specific coverage areas in combination thereby increasing coverage in high traffic areas. While only two examples of applications of the present invention are presented herein, one skilled in the art is capable of exploring many more applications.

It is noted that the present invention may be used in a wide variety of different implementations encompassing many alternatives, modifications, and variations, which are apparent to those with ordinary skill in the art. Accordingly, the present invention is intended to embrace all such alternatives, modifications and variations that fall within the spirit and scope of the appended claims.

What is claimed is:

1. A stratospheric platform system that shares a frequency spectrum with a direct broadcast satellite, said stratospheric platform system comprising:

at least one stratospheric platform having a first predefined coverage area and being parallel with the surface of the ground; and an adjustable platform payload antenna located on said at least one stratspheric platform, said adjustable platform payload antenna being adjustable in at least a first direction to change said first predefined coverage area into a second predefined coverage area wherein said second predefined coverage area excludes areas of interference between said at least one stratospheric platform and the direct broadcast satellite system.

2. The system as claimed in claim 1 further comprising said adjustable platform payload antenna being adjustable in a second direction.

3. The system as claimed in claim 1 wherein said first direction is a north-south direction defining an elevation angle.

4. The system as claimed in claim 2 wherein said second direction is an east-west direction defining an azimuth angle.

5. A method for altering the coverage area provided by a stratospheric platform system to share a frequency spectrum with a direct broadcast satellite system, said method comprising the steps of:

defining blocking areas for a service area associated with the stratospheric platform system, the blocking areas being defined as areas of interference between the stratospheric platform system and the direct broadcast satellite system, the blocking areas being dependent upon a position of the stratospheric platform; and adjusting a platform payload antenna in at least a first direction to change the coverage area for the stratospheric platform system and exclude the blocking areas from coverage by the stratospheric platform system.

6. The method as claimed in claim 5 further comprising the step of adjusting said payload antenna in a second direction to change the coverage area for the stratospheric platform system and exclude the blocking areas from coverage by the stratospheric platform system.

7. A method for designing a coverage area for a stratospheric platform system having at least one stratospheric platform and an adjustable payload antenna on said at least one stratospheric platform, said method comprising the steps of:

adjusting the payload antenna in a first direction to define the shape and location of a first coverage area;

adjusting the payload antenna in at least a second direction to further define the shape and location of at least a second coverage area; and combining the first and second coverage areas to provide a greater concentration of coverage in an area having a high demand for coverage.

8. The method as claimed in claim 7 further comprising the steps of:

determining a distribution of communication traffic in a predetermined area;

defining a shape and location of said first and second coverage areas to include said predetermined area;

whereby combining said first and second coverage areas provides a greater concentration of coverage for said predetermined area.

9. A method of maximizing a coverage area for a stratospheric platform system having a plurality of stratospheric platforms and an adjustable platform payload antenna on each stratospheric platform, said method comprising the steps of:

adjusting said adjustable platform payload antenna on a first stratospheric platform in a first direction to define a shape and location of a first coverage area;

adjusting said adjustable platform payload antenna on at least a second stratospheric platform in a second direction to further define a shape and location of at least a second coverage area; and combining said first coverage area and said at least a second coverage area to provide a greater concentration of coverage in an area using a minimum number of stratospheric platforms.

10. The method as claimed in claim 9 further comprising the steps of:

determining a distribution of communication traffic in a predetermined area; and combining said first coverage area and said at least a second coverage area to provide a greater concentration of coverage in said predetermined area.

11. A method for customizing communications coverage in a predetermined area of a stratospheric platform system having at least one stratospheric platform and an adjustable platform payload antenna on said at least one stratospheric platform, said method comprising the steps of:

defining an entire area;

determining a predetermined area within said entire area as having a potential for heavy communications traffic;

adjusting said adjustable platform payload antenna in a first direction to define the shape and location of a first coverage area including said predetermined area;

adjusting said adjustable platform payload antenna in at least a second direction to further define the shape and location of at least a second coverage area also including said predetermined area; and combining said first coverage area and said at least a second coverage area to focus a greater concentration of coverage in said predetermined area for potentially heavy communications traffic.

12. The method as claimed in claim 11 wherein said steps of adjusting said adjustable platform payload antenna further comprise adjusting a position of said least one stratospheric platform.

13. The method as claimed in claim 11 wherein said steps of adjusting said adjustable platform payload antenna further comprise adjusting a position of said adjustable platform payload antenna.

14. A stratospheric platform system comprising:

at least one stratospheric platform having a first predefined coverage area; and an adjustable platform payload antenna located on said at least one stratospheric platform, said adjustable platform payload antenna being adjustable in at least a first direction to change from said first predefined coverage area to a second predefined coverage area, wherein said second predefined coverage area excludes areas of interference between said at least one stratospheric platform and a direct broadcast satellite system.

15. The system as claimed in claim 14 wherein said adjustable platform payload antenna is adjusted by said at least one stratospheric platform being adjustable with respect to a surface of the ground.

16. The system as claimed in claim 14 wherein said adjustable platform payload antenna is adjusted by said adjustable platform payload antenna being adjustable with respect to said at least one stratospheric platform.

* * * * *